US011517959B2

(12) United States Patent
Dugenne et al.

(10) Patent No.: US 11,517,959 B2
(45) Date of Patent: Dec. 6, 2022

(54) PORTABLE HYDRAULIC POWER TOOL

(71) Applicant: Apex Brands, Inc., Apex, NC (US)

(72) Inventors: Christophe Dugenne, Viry-Chatillon (FR); Romain Delanoue, Fleury-les-Aubrais (FR)

(73) Assignee: APEX BRANDS, INC., Apex, NC (US)

( * ) Notice: Subject to any disclaimer, the term of this patent is extended or adjusted under 35 U.S.C. 154(b) by 924 days.

(21) Appl. No.: 16/337,169

(22) PCT Filed: Sep. 29, 2017

(86) PCT No.: PCT/US2017/054481

§ 371 (c)(1),
(2) Date: Mar. 27, 2019

(87) PCT Pub. No.: WO2018/064564

PCT Pub. Date: Apr. 5, 2018

(65) Prior Publication Data

US 2019/0224742 A1 Jul. 25, 2019

Related U.S. Application Data

(60) Provisional application No. 62/402,329, filed on Sep. 30, 2016.

(51) Int. Cl.
*B21J 15/22* (2006.01)
*B21J 15/02* (2006.01)
(Continued)

(52) U.S. Cl.
CPC ..... *B21J 15/22* (2013.01); *B21J 15/02* (2013.01); *B21J 15/105* (2013.01); *B25F 5/005* (2013.01)

(58) Field of Classification Search
CPC ..... B21J 15/02; B21J 15/22; B21J 15/105
See application file for complete search history.

(56) References Cited

U.S. PATENT DOCUMENTS 2,169,423 A 8/1939 Kessler et al.
5,634,264 A * 6/1997 Dear ..... B21J 15/105 72/391.6

(Continued)

OTHER PUBLICATIONS

International Search Report and Written Opinion of corresponding International Application No. PCT/US2017/054481 dated Dec. 6, 2017, all enclosed pages cited.

(Continued)

*Primary Examiner* — Seahee Hong
(74) *Attorney, Agent, or Firm* — Burr & Forman LLP

(57) ABSTRACT

A hydraulic power tool is provided including a rivet squeezer comprising two opposing surfaces, a hydraulic cylinder configured to move the surfaces between an open position and a compressed position, a hydraulic pump configured to provide hydraulic pressure to actuate the hydraulic cylinder in a first direction, and an air tank configured to provide pneumatic pressure to actuate the hydraulic cylinder in a second direction. Actuation of the hydraulic cylinder in the first direction causes the surfaces to move from the open position to the compressed position and actuation of the hydraulic cylinder in the second direction causes the surfaces to move from the compressed position to the open position.

17 Claims, 14 Drawing Sheets

(51) Int. Cl.
*B21J 15/10* (2006.01)
*B25F 5/00* (2006.01)

(56) References Cited

U.S. PATENT DOCUMENTS

| | | | | |
|---|---|---|---|---|
| 6,886,226 | B1 | 5/2005 | Dear et al. | |
| 8,935,948 | B1 | 1/2015 | Gregory | |
| 2002/0148089 | A1* | 10/2002 | Frenken | B21J 15/025<br>29/243.53 |
| 2014/0328695 | A1* | 11/2014 | Hippe | B21J 15/22<br>417/437 |
| 2016/0332215 | A1* | 11/2016 | Blacket | H02K 41/02 |

OTHER PUBLICATIONS

Chapter I International Preliminary Report on Patentability of corresponding International Application No. PCT/US2017/054481 dated Apr. 11, 2019, all enclosed pages cited.
Office Action from Chinese application No. 201780074154.7, dated Feb. 6, 2020, all enclosed pages cited.
Office Action from Chinese application No. 201780074154.7, dated Nov. 20, 2020, all enclosed pages cited.
"Hydraulic Cylinder with Pneumatic-hydraulic Spring Retain and its System Design", Shang Zengwen, ("Hydraulic and Pneumatics"), Issue 2, 2004, pp. 4-5.

* cited by examiner

| | Weight |
|---|---|
| Common components | 17,7 kg |
| AC/DC | 24,0 kg (+ 6,3) |
| DC only | 19,8 kg (+ 2,1) |
| AC only | 20,5 kg (+ 2,8) |
FIG. 13
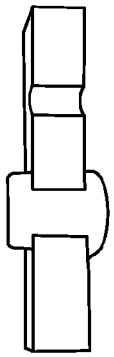
FIG. 14A
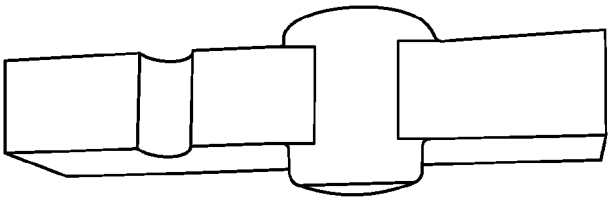
FIG. 14B

PORTABLE HYDRAULIC POWER TOOL

CROSS REFERENCE TO RELATED APPLICATIONS

This application claims priority to U.S. application No. 62/402,329 filed Sep. 30, 2016, the entire contents of which are hereby incorporated by reference in their entirety.

TECHNICAL FIELD

Example embodiments generally relate to power tools and, in particular, relate to a portable hydraulic power tool.

BACKGROUND

Typical hydraulic power tools, such as a high power riveter, e.g. approximately 700 bar/10,000 psi, generally plug into a power outlet and/or are plugged into a hydraulic or pneumatic pressure outlet. Plugging the hydraulic power tool into one or more outlets may cause wires and/or hoses to be laid out across a working area, such as a factory. Traditional hydraulic power tools may also be heavy, such as 35 kg or more, making maneuverability of the hydraulic power tool to the work site difficult. Additionally, traditional hydraulic power tools may be loud, such as 85 decibels or more, which may significantly add to work site noise levels.

BRIEF SUMMARY OF SOME EXAMPLES

According to some example embodiments, a hydraulic power tool is provided including a rivet squeezer comprising two opposing surfaces, a hydraulic cylinder configured to move the surfaces between an open position and a compressed position, a hydraulic pump configured to provide hydraulic pressure to actuate the hydraulic cylinder in a first direction, and an air tank configured to provide pneumatic pressure to actuate the hydraulic cylinder in a second direction. Actuation of the hydraulic cylinder in the first direction causes the surfaces to move from the open position to the compressed position and actuation of the hydraulic cylinder in the second direction causes the surfaces to move from the compressed position to the open position.

BRIEF DESCRIPTION OF THE SEVERAL VIEWS OF THE DRAWING(S)

Having thus described the power tool in general terms, reference will now be made to the accompanying drawings, which are not necessarily drawn to scale, and wherein:

FIG. 13 illustrates an example chart of riveter weights for given power configurations according to an example embodiment.

Figure 1:
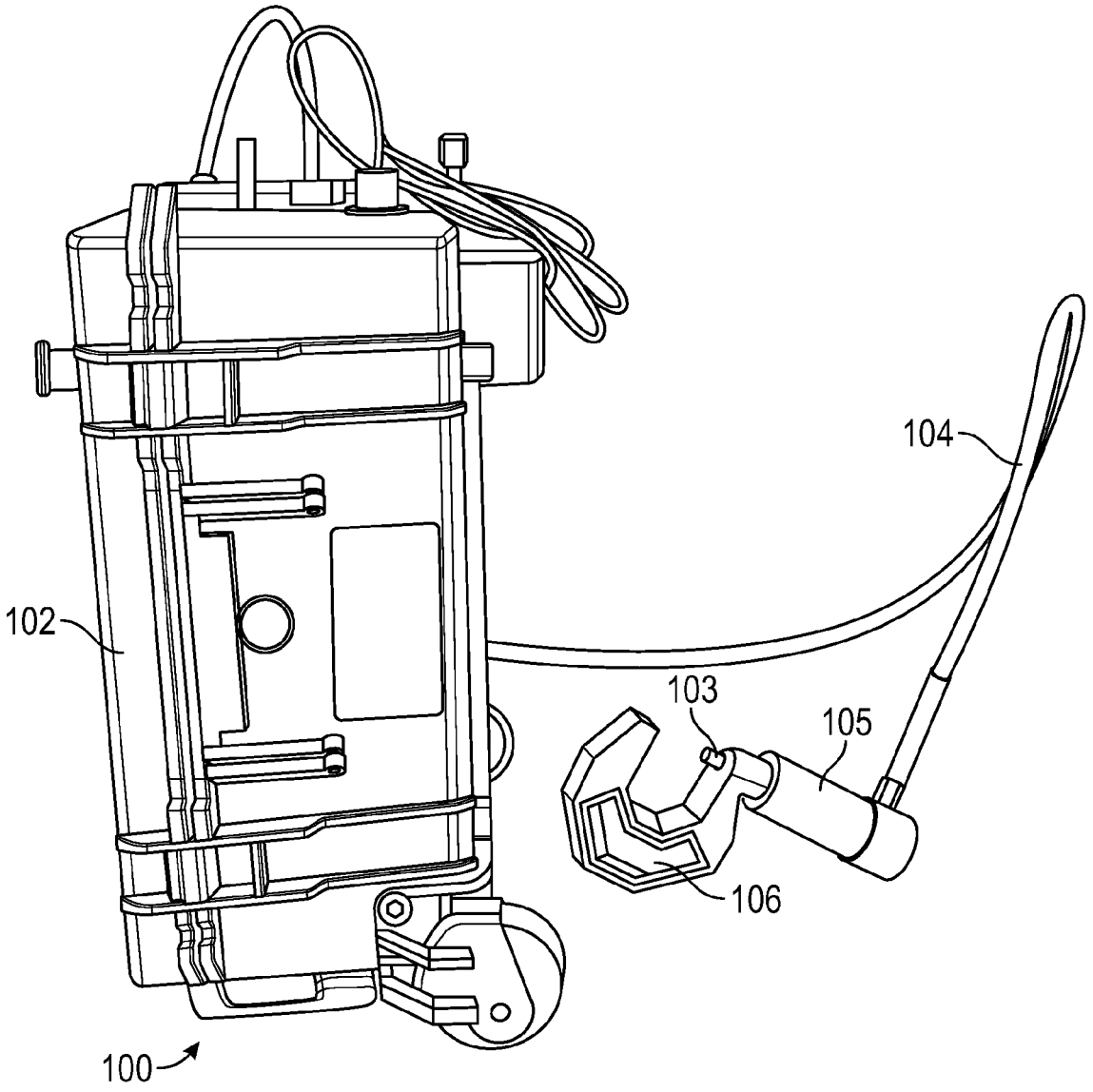
FIG. 1 illustrates an example hydraulic power tool according to an example embodiment.

FIG. 14, which is defined by FIGS. 14A and 14B, illustrates example cross-sections of compressed rivets according to an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. As used herein, operable coupling should be understood to relate to direct or indirect connection that, in either case, enables functional interconnection of components that are operably coupled to each other.

A high power hydraulic tool, e.g. riveter, is provided including a hydraulic pump and an air tank. Actuation of the riveter may cause hydraulic pressure to be applied to a first side of a hydraulic or hydropneumatic cylinder, which in turn may cause a rivet squeezer to move from an open position to a compressed position. Additionally, air pressure, may be transferred from the second side of the hydropneumatic cylinder to an air tank, e.g. reservoir. Once the rivet operation has been completed the hydraulic pressure may be removed from the first side of the hydropneumatic cylinder. The air pressure accumulated in the air tank may cause the hydropneumatic cylinder to cause the rivet squeezer to return to the open position.

In some example embodiments, the riveter may be battery powered. The battery power may be utilized to generate hydraulic or pneumatic pressure. Local generation of hydraulic or pneumatic pressure from a local power supply may reduce or eliminate cables and/or hoses to supply hydraulic or pneumatic pressure and/or electrical power.

In an example embodiment, the riveter may be light weight compared to typical riveters, such as 30 kg, 15 kg, or less. In some example embodiments, the riveter may produce significantly less noise than a typical riveter, such as 70 dB, 62 dB, or less.

In some example embodiments, the riveter may be actuated by an electronic actuation switch. The actuation, e.g. depression, of the electronic actuation switch may cause a hydraulic pump to generate the hydraulic pressure and/or cause a solenoid valve to port hydraulic pressure to the first side of the hydropneumatic cylinder. Release of the electronic actuation switch may cause the hydraulic pump to stop generating hydraulic pressure and/or cause the solenoid valve to relieve pressure from the first side of the hydropneumatic cylinder.

Example Hydraulic Power Tool

Figure 9:
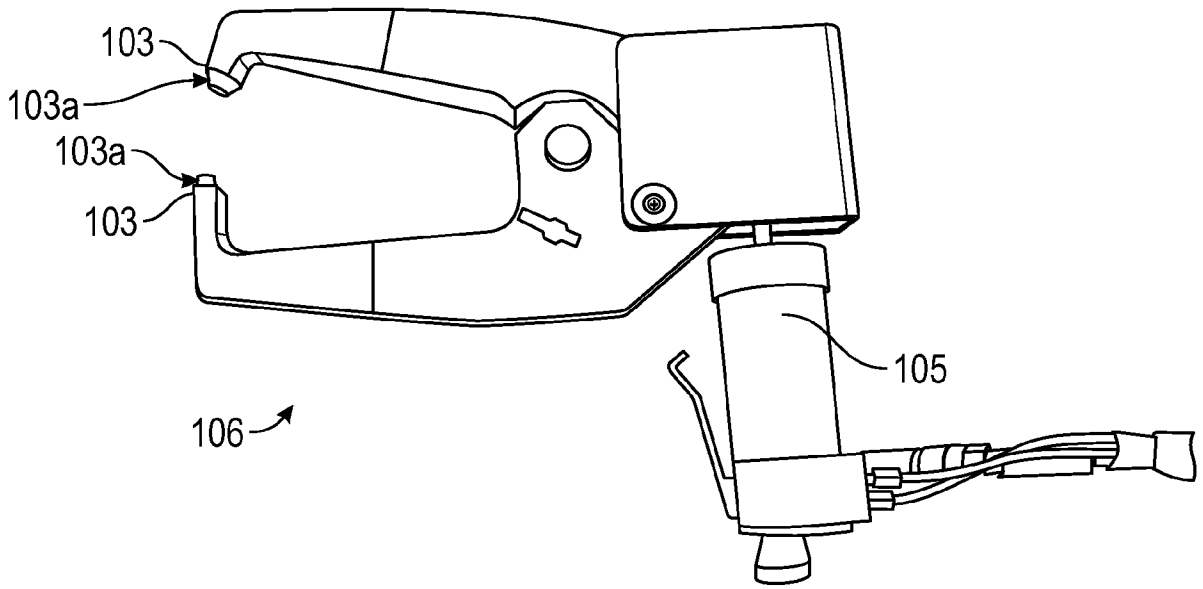
FIG. 9 illustrates an example rivet squeezer according to an example embodiment.

An example embodiment of the hydraulic power tool will now be described in reference to FIG. 1. FIG. 1 illustrates a hydraulic power tool, e.g. riveter 100, in accordance with an example embodiment. The riveter 100 may include a control system 102, a hose 104, and a rivet squeezer 106. The rivet squeezer 106 may also include a hydraulic or hydropneumatic cylinder 105. In some example embodiments, the rivet squeezer may be an alligator squeezer design, having opposing surfaces 103, such as a fixed surface and a positionable (or movable) surface. The opposing surfaces 103 may be disposed at or on arms (again, one of which may be movable while the other remains fixed). The arms may be oriented to face each other (or position the surfaces 103 to face each other) across a gap. Thus, for example, if the surfaces 103 are disposed at ends of the arms, the arms may form a U shape or C shape in some cases. In some embodiments, the control system 102 may be housed within a case, such as a plastic case, metal case, or the like. The case may also include one or more wheels, a handle, or the like, to allow for increased mobility and maneuverability. Although described herein as including rivet bits 103*a*, as depicted in FIG. 9 to squeeze rivets, one of ordinary skill in the art would immediately appreciate that the rivet squeezer 106 may utilize other hydraulic tools, such as punches, dies, or the like.

Figure 2A:
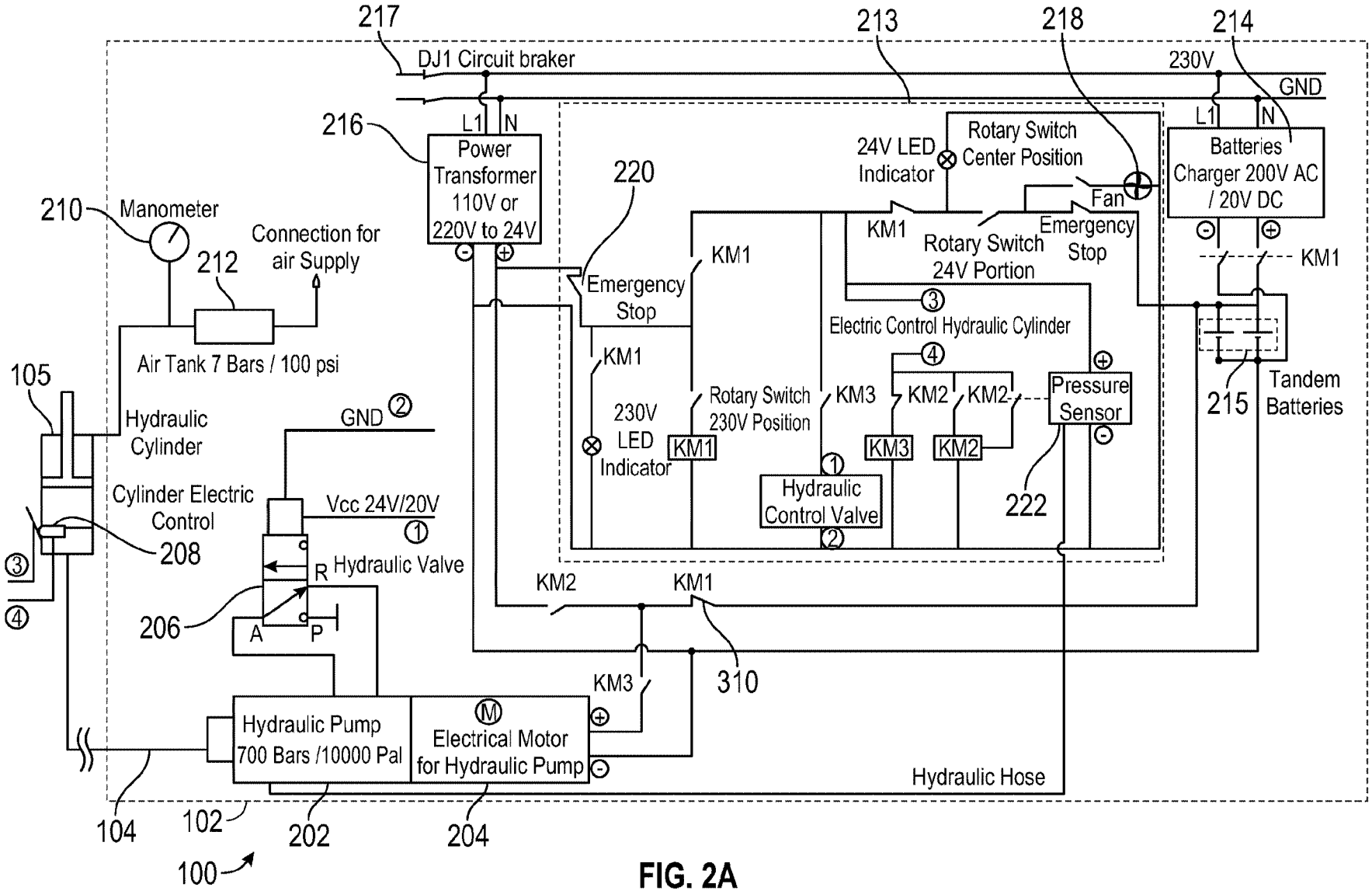
FIGS. 2A-2C illustrate an example schematic of a riveter according to an example embodiment.
Figure 2B:
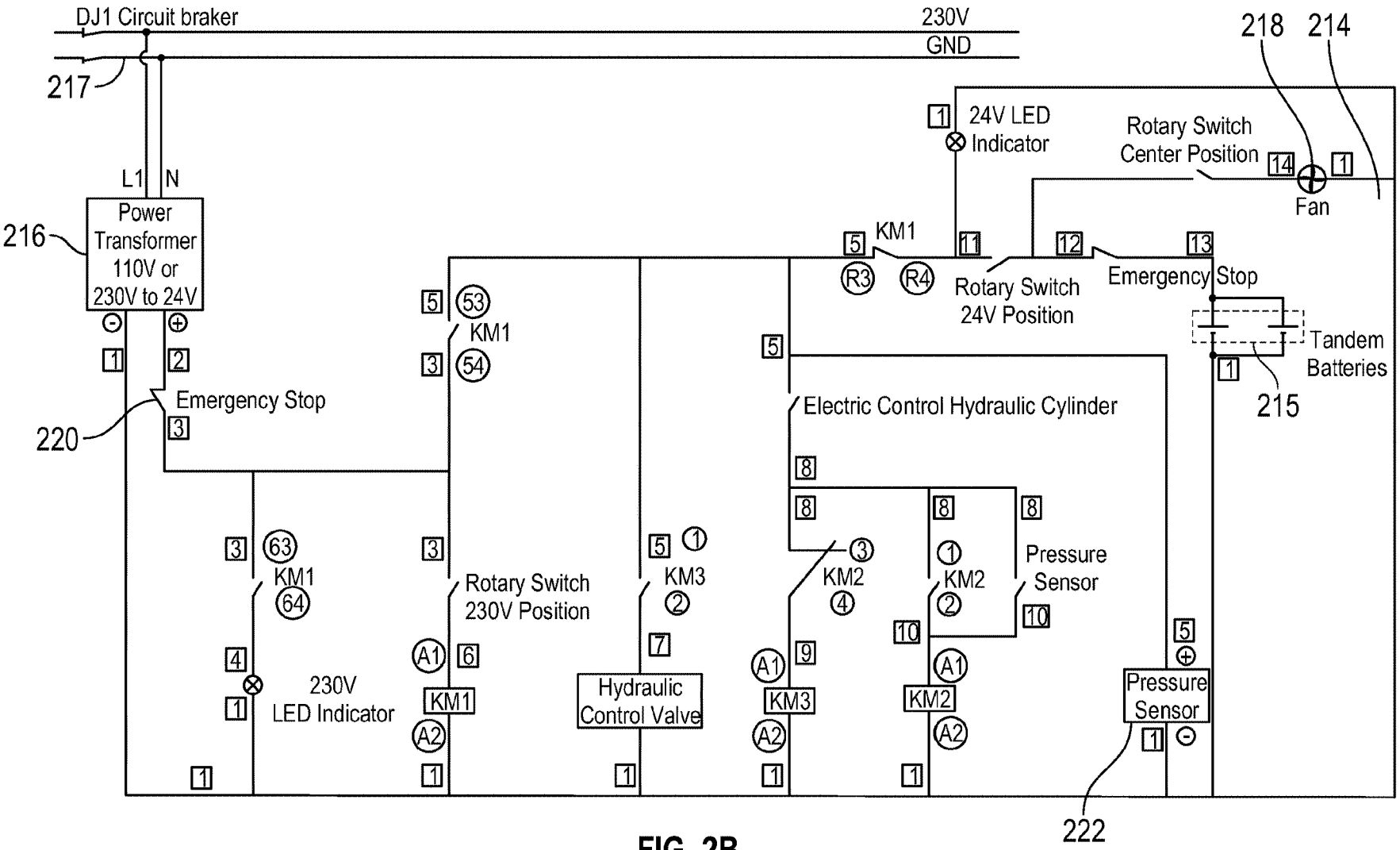
Figure 2C:
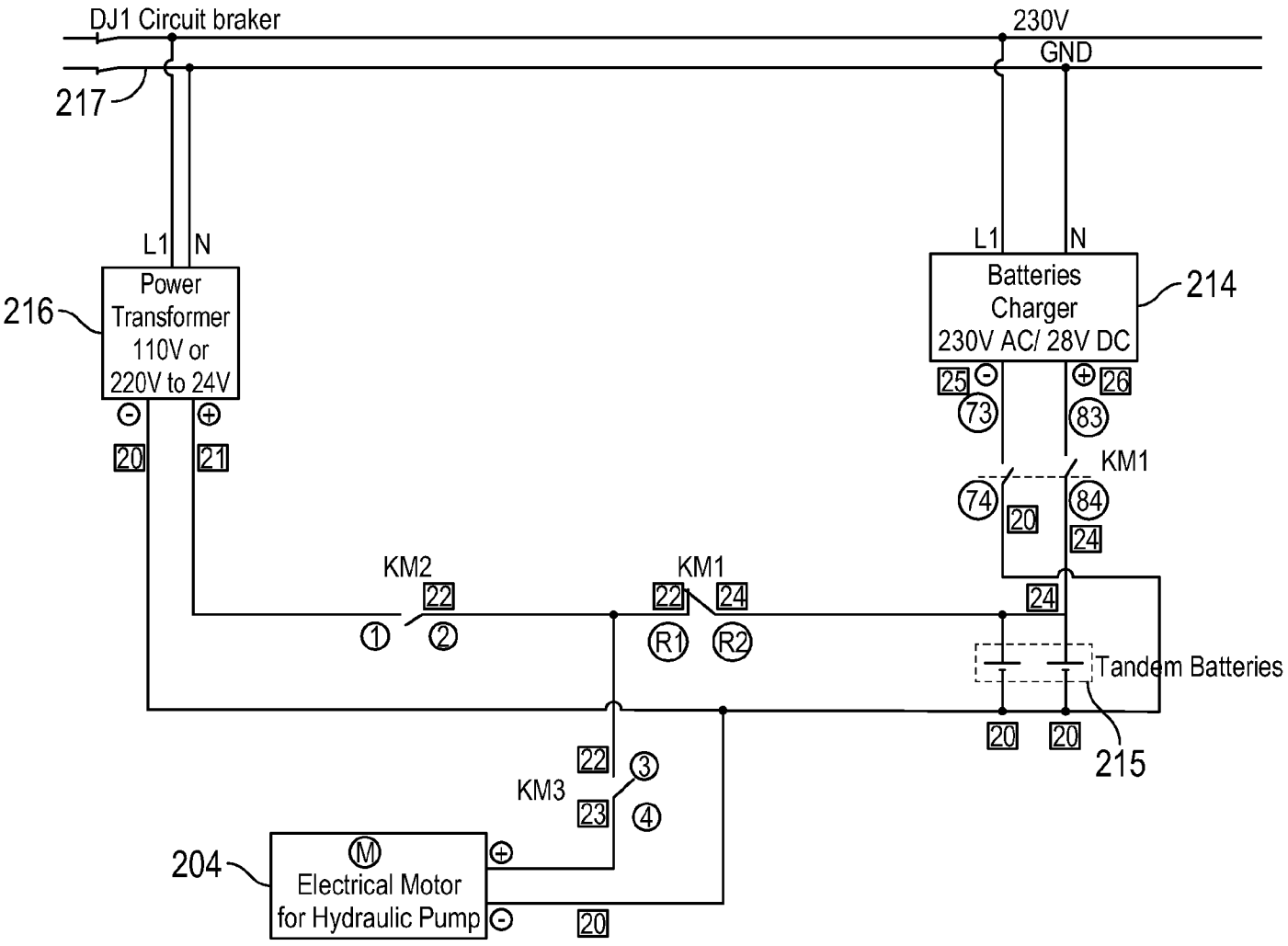
Figure 3:
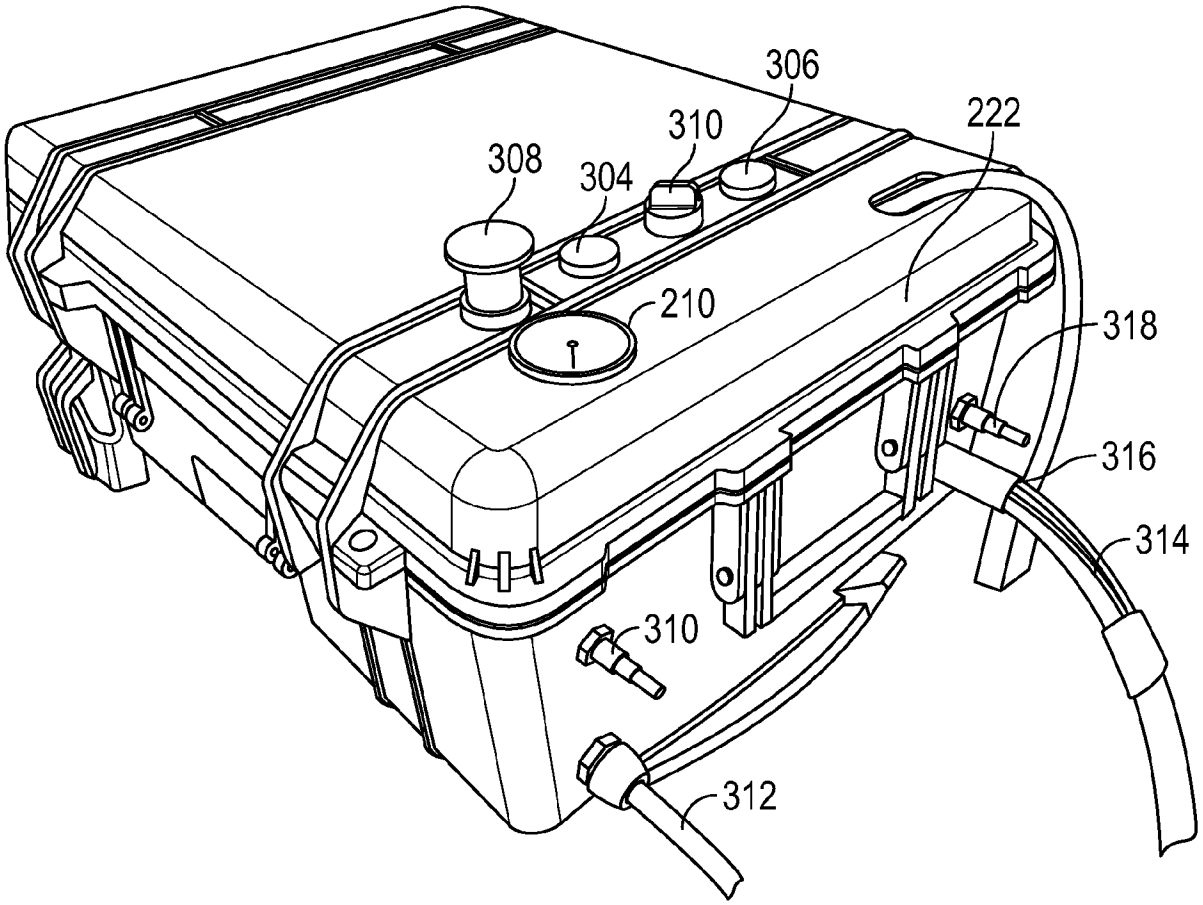
FIGS. 3-5 illustrate external views of an example riveter according to an example embodiment.
Figure 4:
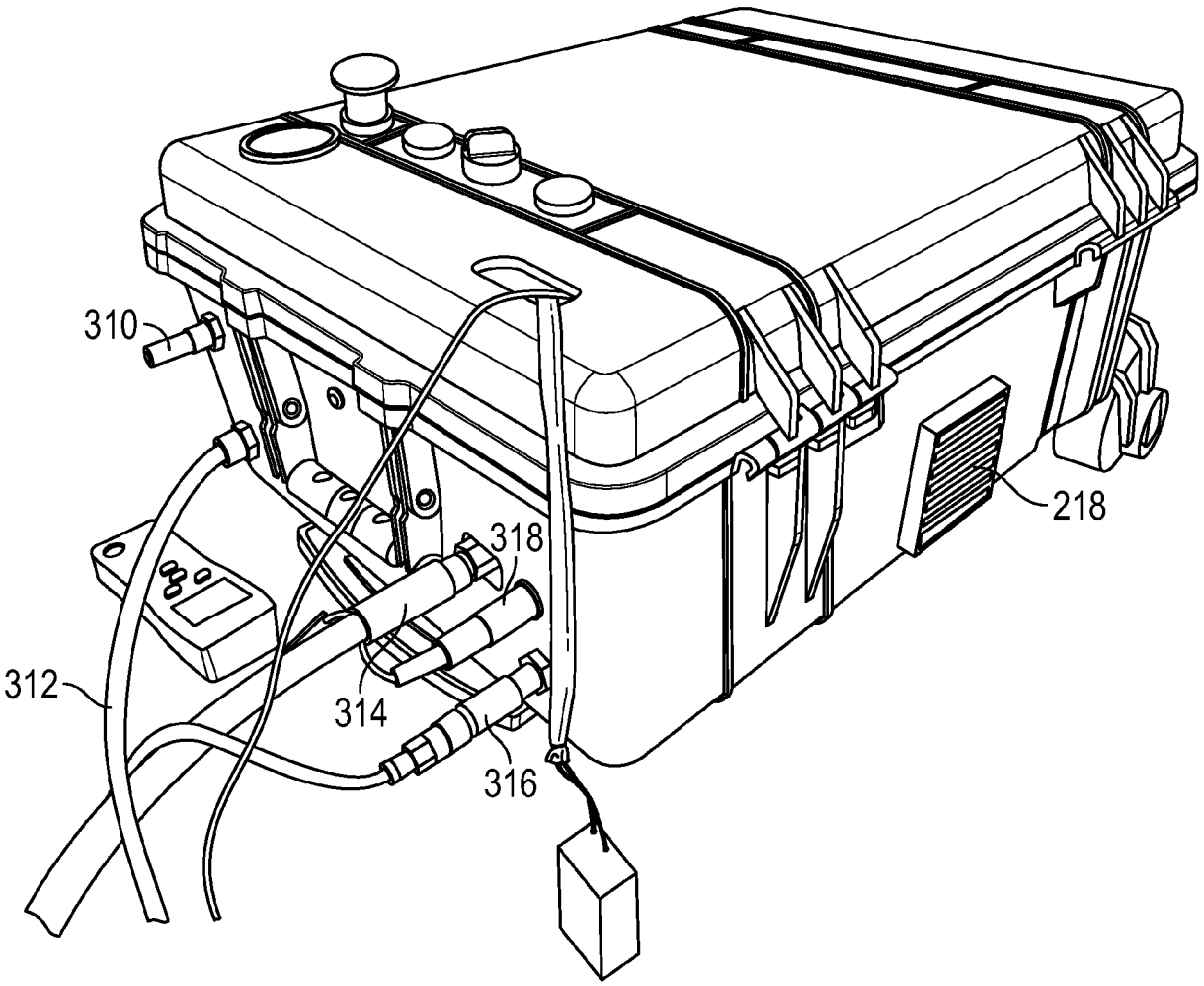
Figure 5:
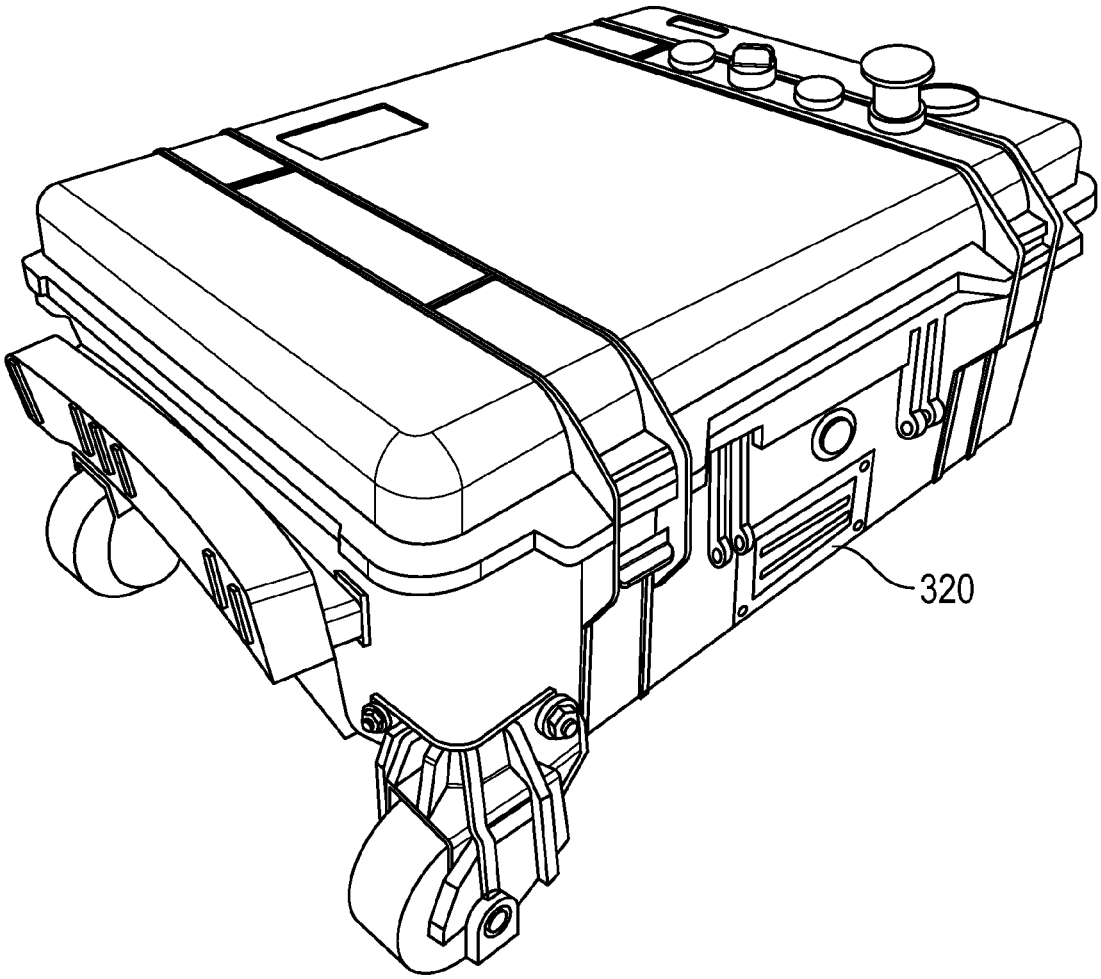
Figure 6:
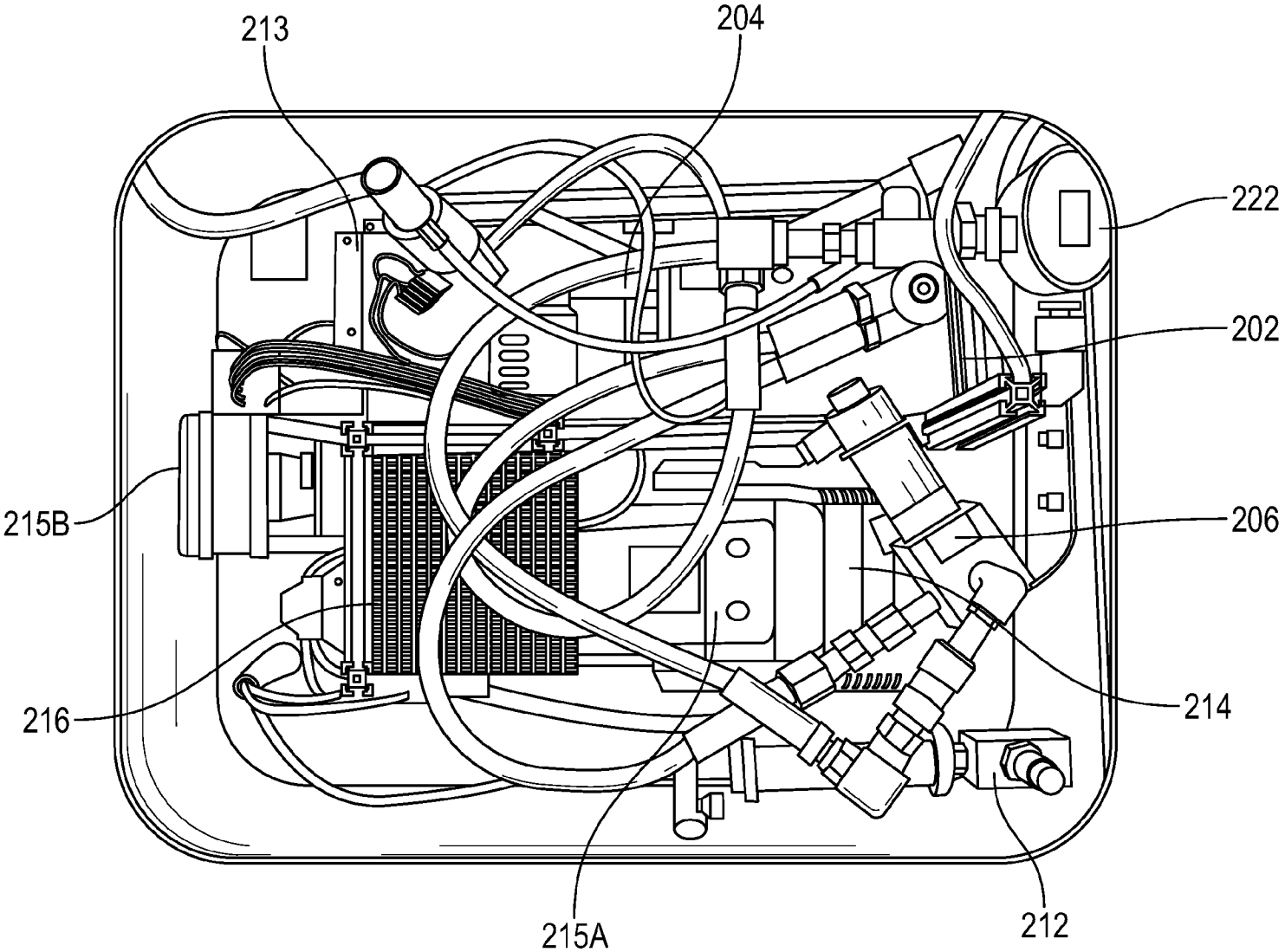
FIGS. 6-8 illustrate internal views of an example riveter according to an example embodiment.
Figure 7:
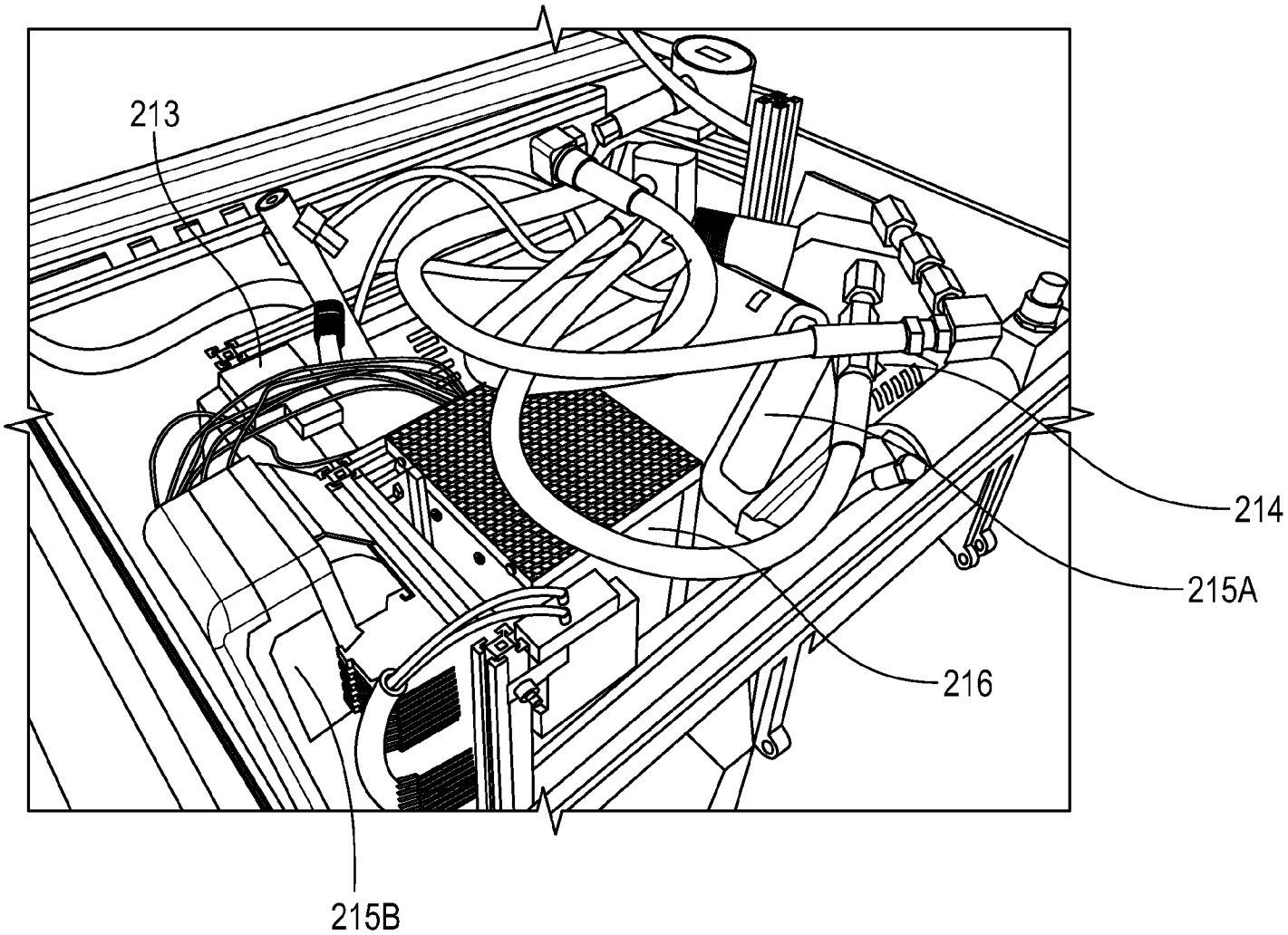
Figure 8:
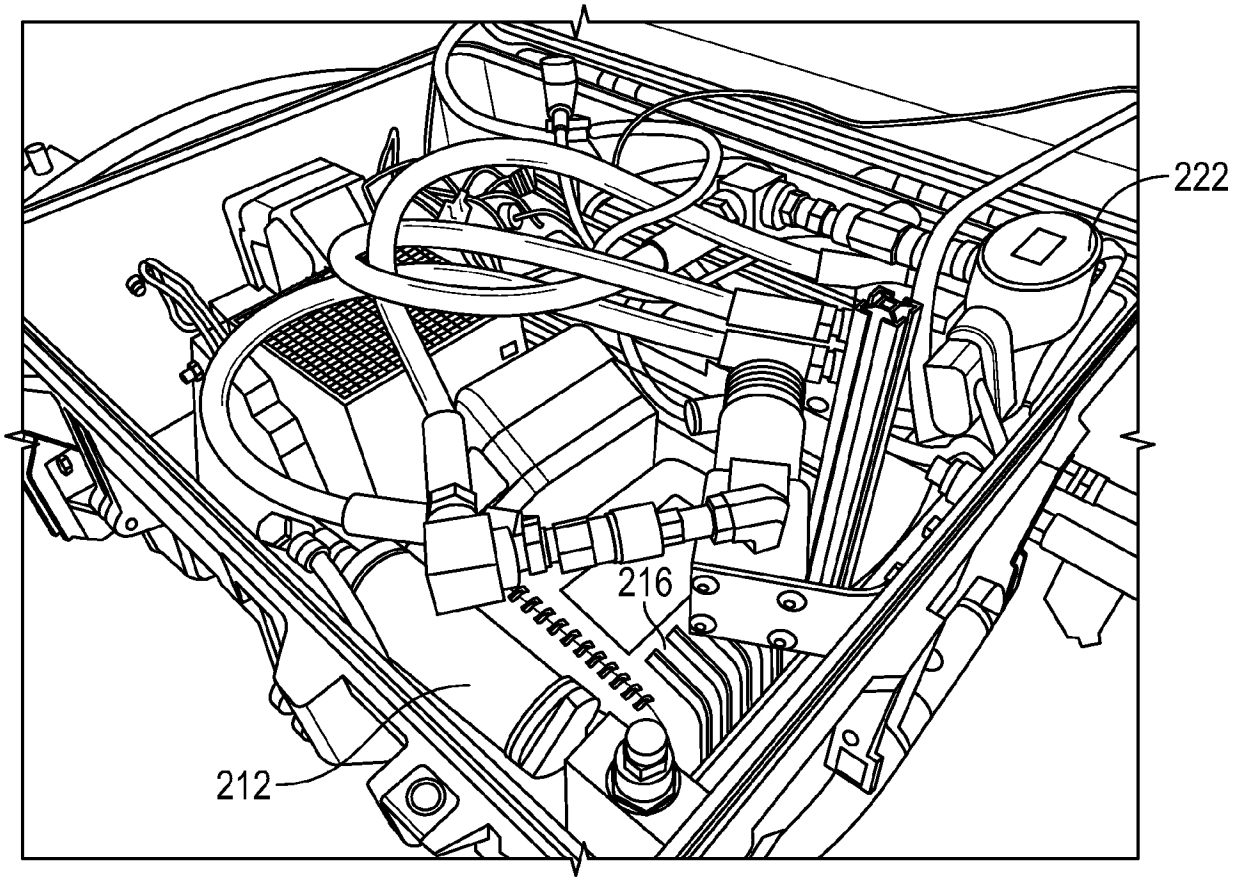

FIG. 2A illustrates an example schematic of the riveter 100. FIG. 2B illustrates a control portion of the schematic, and FIG. 2C illustrates a power portion of the schematic. FIGS. 3-9 illustrate internal and external views of the riveter 100. The riveter 100 may include one or more power supplies. A first power supply may include an external power source, such as an alternating current (AC) power input 217, e.g. 110 VAC, 220 VAC, 230 VAC, 440 VAC, or the like. The AC power input 217 may be transformed to a lower direct current (DC) voltage, such as 18 VDC, 24 VDC, 28 VDC, or the like, by power transformer 216. The power supplies may also include one or more rechargeable batteries 215 and a battery charger 214. The battery charger may be configured to receive the AC power input 217 and charge the batteries 215 at a lower DC voltage, such as 18 VDC, 24 VDC, 28 DVC or the like. In some example embodiments the riveter may be AC power only or DC power only.

A user may select the power supply by positioning a power supply switch 310 to an AC power, a DC power or an off position, in which no power supply is selected. The power supply switch 310 may be a toggle switch, a rotary switch, or the like. Positioning the power switch 310 to the 28 VDC position may open charging contacts from the battery charger 214 to the battery, illuminate a 28 VDC indicator 304, and supply power to the electric motor 204 on demand, as discussed below. Positioning the power supply switch 310 to a 230 VAC position may cause a 230 VAC indicator 306 to illuminate and supply power to the electric motor 204 on demand. In some example embodiments an emergency stop switch 308, such as a push button switch, is provided to interrupt both power supplies.

In an example embodiment a plurality of electronic switches 213, such as electromagnetic relays, transistors, or the like, are provided to route control power to a the electric motor 204, a hydraulic valve 206, an electronic actuation switch 208, a fan 218, or the like, as described below. In some embodiments, the various switches discussed herein may be inputs to and/or controlled by processing circuitry, which may include a processor and a memory including computer program code.

Actuation of the electronic actuation switch 208 may cause the electric motor 204 to energize and the hydraulic valve 206 to shut to allow hydraulic pressure to build. The electric motor 204 may cause a hydraulic pump 202 to generate high hydraulic pressure, such as approximately 700 bar/10,000 psi. In some embodiments, the hydraulic pressure may less than 700 bar/10,000 psi based on the application. The hydraulic valve 206 may be configured to shut to port the hydraulic pressure to a first side of a piston of the hydraulic or hydropneumatic cylinder 105 through hose 104. The hydraulic valve 206 may also be configured to open to relieve the hydraulic pressure applied to the hydropneumatic cylinder 105 by venting to a pump bladder.

An air tank 212 may provide air pressure to a second side of the piston of the hydropneumatic valve 105, which may be indicated on manometer 210. The air pressure may be 5 bar, 6 bar, 7 bar, 8 bar, or the like. Movement of a piston of the hydropneumatic cylinder 105 from a first position to a second position may cause additional air pressure to be applied to air tank 212 and indicated by manometer 210. Relieving the hydraulic pressure by hydraulic valve 206 may cause the air pressure in the air tank 212 to cause the piston of the hydropneumatic cylinder 105 to return to the first position.

The first position of the piston of the hydropneumatic cylinder 105 may be associated with an open position of the rivet squeezer 106 and the second position of the piston of the hydropneumatic cylinder 105 may be associated with a compressed position of the rivet squeezer. Movement of the piston of the hydropneumatic cylinder 105 from the first position to the second position may cause the opposing surfaces 103 including rivet bits 103*a* of the rivet squeezer 106, as depicted in FIG. 9, to apply the hydraulic pressure, e.g. approximately 700 bar/10,000 psi, to a rivet. Movement of the piston of the hydropneumatic cylinder 105 from the second position to the first position may cause opposing surfaces 103 of the rivet squeezer 106 to return to an open position.

In some embodiments, a pressure sensor 222 may be provided to measure the hydraulic pressure or the air pressure. In some instances the pressure sensor 222 may measure the air pressure indirectly by measuring the hydraulic pressure of the air pressure applied to the second side of the piston of the hydropneumatic cylinder 105, which is transferred to the second side, e.g. hydraulic side of the piston of the hydropneumatic. The pressure sensor 222 may be an analog or digital pressure sensor 222 and may read out in units of pressure or force. In an example embodiment, the pressure sensor may include a converter configured to export a pressure curve measurement associated with a rivet cycle.

In some example embodiments, the riveter 100 may include a fan 218 to cool the hydraulic pump 202, electric motor 204, electronic switches 213, or the like. The fan 218 may receive air from air intake 320.

The riveter 100 may also include a 230 VAC cable to supply the 230 VAC and/or an air supply connection 310 to charge the air tank 212. In some example embodiments, the hose 104 may include one or more of an oil hose 314, an air hose 316, and electrical cables 318 for the electronic actuation switch 208.

Figure 10:
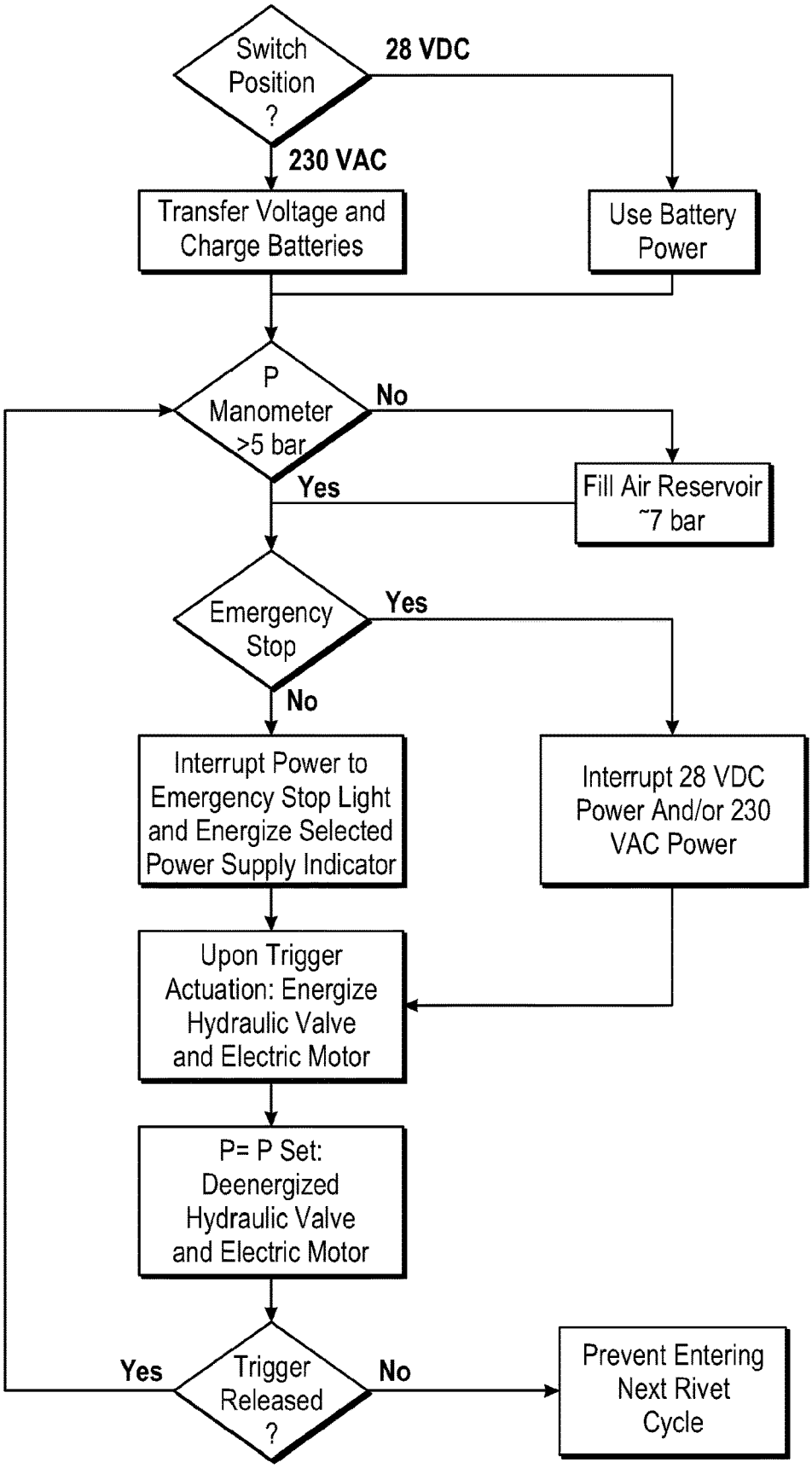
FIG. 10 illustrates an example riveter operation flowchart according to an example embodiment.

In operation, as depicted in FIG. 10, a user may choose the electrical power supply by positioning the power supply switch 310 to the 28 VDC position or the 230/110 VAC position. In response to selecting the 28 VDC position, an electronic switch 213, e.g. relay KM1, disconnects power transformer 216. In response to selecting the 230/110 VAC position, relay KM1 disconnects batteries 215 and connects the 230V-to-28V battery charger 214 to batteries 215 to charge the batteries 215. In an example embodiment, the KM1 relay may also illuminate the 28 VDC indicator 304 (Green) or the 230 VAC indicator 306 (White), and/or start fan 218 for heat protection.

In some example embodiments, a user may set a riveting force with the pressure sensor 222, such as 10 daN, 700 bar, 10,000 psi, or the like. The user may additionally check an initial air tank pressure, such as greater than 5 bar with a maximum pressure of approximately 8 bar to supply return pressure. The emergency stop button 308 may interrupt power to the electric motor 204, and/or the hydraulic valve 206. Additionally, the emergency stop may illuminate an emergency stop indicator (Red), and/or deluminate the 28 VDC power indicator 304 or 230 VAC power indicator 306.

A user may position the rivet squeezer 106 for riveting. Riveting operation may begin when the user activates the electric actuation switch 208, e.g. trigger. Actuation of the electronic actuation switch may energize an electronic switch 213, e.g. KM3, supplying power to the electric motor 204, and the hydraulic valve 206. The hydraulic valve 206 may shut closing a hydraulic return path and allowing the hydraulic pump 202 to apply hydraulic pressure to the hydropneumatic cylinder 105 to move the piston of the hydropneumatic cylinder 105 from the first position to the second position, which in turn, causes the opposing surfaces 103 including rivet bits 103*a* of the rivet squeezer 106 to apply pressure to the rivet. In response to an increase in pressure, the pressure sensor 222 may increment a cycle counter.

In response to the hydraulic pressure reaching a predetermined pressure, e.g. the set pressure, the pressure sensor 222, energizes an electronic switch, e.g. KM2 relay. The KM2 relay may be a self latching or locking relay. Energizing the KM2 relay may cause the KM3 relay to be de-energized interrupting power to the electric motor 204 and the hydraulic valve 206. De-energizing the hydraulic valve may cause the hydraulic valve to return to the open, e.g. rest position, porting hydraulic fluid to a pump bladder to relieve the hydraulic pressure applied to the hydropneumatic cylinder 105. The air pressure of the air tank 212 may cause the piston of the hydropneumatic cylinder 105 to return to the first position, which in turn, caused the opposing surfaces 103 of the rivet squeezer 106 to return to an open position.

In an example embodiment, the electronic actuation switch 208 may be released allowing the KM2 relay to reset, e.g. unlock. A subsequent rivet cycle may be performed in response to the KM2 relay resetting. In an example embodiment, the first or subsequent rivet cycles may be performed in response to satisfying one or more actuation criteria, for example, air pressure or hydraulic pressure satisfying a predetermine pressure threshold indicative of the opposing surfaces 103 being in the open position, the electronic actuation switch 105 not being actuated, or the like. In an example embodiment, the KM2 relay may reset in response to one or both of the pressure sensor 222 indicating that the hydraulic pressure or air pressure satisfies the predetermined threshold and the electronic actuation switch 105 being released or not actuated.

Figure 11:
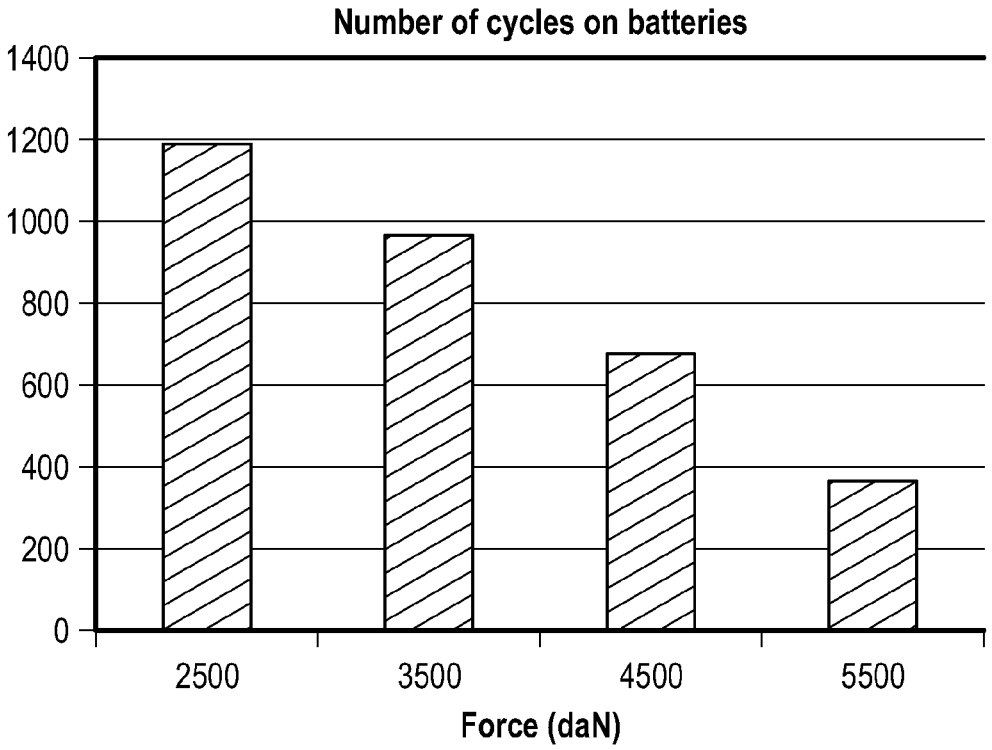
FIG. 11 illustrates an example graph of rivet cycles per battery charge for given rivet pressures according to an example embodiment.

FIG. 11 illustrates an example graph of rivet cycles per battery charge for given rivet pressures according to an example embodiment.

Figure 12:
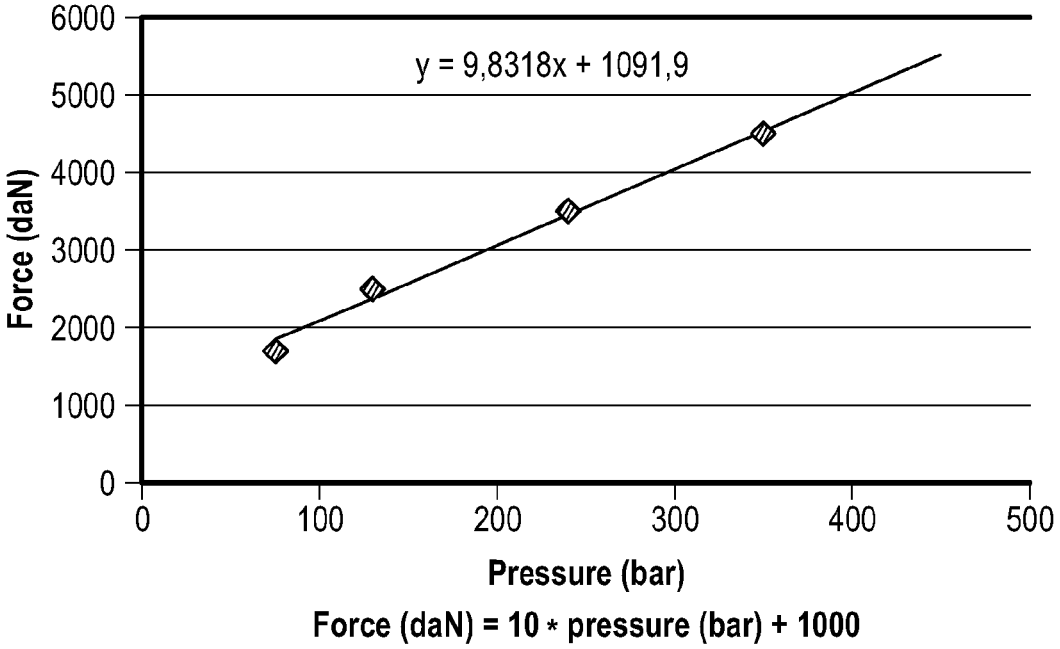
FIG. 12 illustrates an example graph of rivet pressure for given hydraulic pressures according to an example embodiment.

FIG. 12 illustrates an example graph of rivet pressure for given hydraulic pressures according to an example embodiment.

FIG. 13 illustrates an example chart of riveter weights for given power configurations according to an example embodiment. The riveter weights may be for the control system 102 portion of the riveter 100. For example common components of an example embodiment may weigh approximately 17.7 kg. The weight of a riveter 100 with an AC and DC power supply may be approximately 24 kg. The weight of a riveter 100 with only a DC power supply may be approximately 19.8 kg. The weight of a riveter 100 with only an AC power supply may be approximately 20.5 kg. The construction of the riveter may allow for a significant weight reduction over a typical riveter, for example the riveter may be less than 30 kg, 30-15 kg, 30-20 kg, 30-25 kg, 30-28 kg, 28-25 kg, 25-23 kg, 23-20, kg, 20-17 kg, 17-15, kg, or the like. In some examples the riveter 100 may be less than 15 kg, 15-10 kg, 15-13 kg, 13-10 kg, or the like. In an example embodiment, using air pressure to return the rivet squeezer to the open position, instead of using hydraulic pressure and/or a mechanical means, such as a spring, may reduce noise produced by operation of the riveter 100 at 1 m. For example the riveter may produce less than 75 dB, 75-73 dB, 73-70 dB, or the like. In an example embodiment, the riveter may produce less than 70 dB, 70-62 dB, 70-68 dB, 70-65 dB, 68-65 dB, 65-62 dB, or the like. In some examples, the riveter 100 may produce less than 62 dB, 62-45 dB, 62, 50 dB, 62, 55 db, 55-50 dB, 55-45 dB, 50-45 dB, 62-60 db, or the like.

FIG. 14 illustrates an example compressed rivet according to an example embodiment.

In some embodiments, the power tool may be further configured for optional modifications. In this regard, for example, the hydraulic power tool may also include an electronic actuation switch and actuation of the electronic actuation switch may cause hydraulic pump to provide the hydraulic pressure to actuate the cylinder in the first direction. In some example embodiments, the hydraulic power tool also includes a solenoid valve configured to port hydraulic fluid to the hydraulic cylinder in response to the actuation of the actuation switch. In an example embodiment, actuation of the electronic actuation switch causes the hydraulic pump to provide hydraulic pressure in response to meeting one or more actuation criteria. In some example embodiments, the actuation criteria comprise an indication of the surfaces being in the open position. In an example embodiment, the indication of the surfaces in the open position comprises an indication of air pressure of the air tank being less than a predetermined pressure. In some example embodiments, the hydraulic power tool weighs less than 30 kg. In an example embodiment, the hydraulic power tool weighs less than 15 kg. In some example embodiments, operation of the hydraulic power produces less than 70 decibels of noise. In an example embodiment, the operation of the hydraulic power tool produces less than 62 decibels.

Many modifications and other embodiments of the power tool set forth herein will come to mind to one skilled in the art to which these inventions pertain having the benefit of the teachings presented in the foregoing descriptions and the associated drawings. Therefore, it is to be understood that the power tools are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A hydraulic power tool comprising:

a rivet squeezer comprising two opposing surfaces;

a hydraulic cylinder comprising a piston having hydraulic fluid on first side of the piston and air on a second side of the piston, the first side of the piston being opposite the second side of the piston, the hydraulic cylinder being configured to move the surfaces between an open position and a compressed position;

a hydraulic pump configured to provide hydraulic pressure to actuate the piston of the hydraulic cylinder in a first direction by applying a hydraulic pressure on the hydraulic fluid on the first side of the piston; and an air tank configured to provide pneumatic pressure to actuate the hydraulic cylinder in a second direction by applying the pneumatic pressure on the air on the second side of the piston;

wherein actuation of the piston within the hydraulic cylinder in the first direction causes the surfaces to move from the open position to the compressed position and actuation of the hydraulic cylinder in the second direction causes the surfaces to move from the compressed position to the open position;

wherein the hydraulic cylinder moves the surfaces between the open position and the compressed position based on a pressure differential across the piston;

wherein the hydraulic pump is controlled to provide the hydraulic pressure when the surfaces on in the open position based on an indication of air pressure in the air tank being less than a predetermined pressure.

2. The hydraulic power tool of claim 1 further comprising:

an electronic actuation switch, wherein actuation of the electronic actuation switch causes the hydraulic pump to provide the hydraulic pressure to actuate the hydraulic cylinder in the first direction.

3. The hydraulic power tool of claim 2 further comprising:

a solenoid valve configured to port hydraulic fluid to the hydraulic cylinder in response to the actuation of the electronic actuation switch.

4. The hydraulic power tool of claim 2, wherein actuation of the electronic actuation switch causes the hydraulic pump to provide hydraulic pressure in response to meeting an actuation criteria.

5. The hydraulic power tool of claim 4, wherein the actuation criteria comprise an indication of the surfaces being in the open position.

6. The hydraulic power tool of claim 1, wherein the hydraulic power tool weighs less than 30 kg.

7. The hydraulic power tool of claim 1, wherein the hydraulic power tool weighs less than 15 kg.

8. The hydraulic power tool of claim 1, wherein operation of the hydraulic power tool produces less than 70 decibels of noise.

9. The hydraulic power tool of claim 1, wherein the operation of the hydraulic power tool produces less than 62 decibels of noise.

10. The hydraulic power tool of claim 1, wherein the rivet squeezer further comprises a rivet bit.

11. The hydraulic power tool of claim 1, wherein the rivet squeezer further comprises a punch.

12. The hydraulic power tool of claim 1, wherein the rivet squeezer further comprises a die.

13. The hydraulic power tool of claim 1, wherein the hydraulic pump operates responsive to operation of an electric motor.

14. The hydraulic power tool of claim 13, further comprising a battery; and wherein the electric motor is powered by the battery.

15. The hydraulic power tool of claim 1, wherein the surfaces are disposed on a first arm and a second arm, respectively, and wherein the first and second arms face each other across a gap.

16. The hydraulic power tool of claim 15, wherein the first arm is movable and the second arm is fixed.

17. The hydraulic power tool of claim 15, wherein the surfaces are disposed at respective ends of the first and second arms, and wherein the first and second arms form a U shape or C shape.

* * * * *